US008327643B2

(12) United States Patent
Yamamoto et al.

(10) Patent No.: US 8,327,643 B2
(45) Date of Patent: Dec. 11, 2012

(54) STAGING FUEL NOZZLE

(75) Inventors: Takeshi Yamamoto, Tokyo (JP); Kazuo Shimodaira, Tokyo (JP); Kazuaki Matsuura, Tokyo (JP); Yoji Kurosawa, Tokyo (JP); Seiji Yoshida, Tokyo (JP)

(73) Assignee: Japan Aerospace Exploration Agency, Tokyo (JP)

( * ) Notice: Subject to any disclaimer, the term of this patent is extended or adjusted under 35 U.S.C. 154(b) by 194 days.

(21) Appl. No.: 12/790,154

(22) Filed: May 28, 2010

(65) Prior Publication Data

US 2010/0308135 A1 Dec. 9, 2010

(30) Foreign Application Priority Data

Jun. 3, 2009 (JP) ..... 2009-133932

(51) Int. Cl.

| | |
|---|---|
| ***F02C 1/00*** | (2006.01) |
| ***F23D 11/10*** | (2006.01) |
| ***F02M 61/00*** | (2006.01) |
| ***F02M 61/02*** | (2006.01) |
| ***F02M 63/00*** | (2006.01) |

(52) U.S. Cl. ..... 60/743; 60/748; 60/749; 239/403; 239/405; 239/423; 239/424; 239/434; 239/533.2

(58) Field of Classification Search ..... 239/399, 239/400, 402–406, 419, 423, 424, 434, 434.5, 239/533.2, 584; 60/740, 742, 743, 748, 749
See application file for complete search history.

(56) References Cited

U.S. PATENT DOCUMENTS

| | | | | |
|---|---|---|---|---|
| 3,917,173 | A * | 11/1975 | Singh | 239/400 |
| 5,647,538 | A * | 7/1997 | Richardson | 239/405 |
| 6,389,815 | B1 | 5/2002 | Hura et al. | |
| 2006/0021350 | A1 * | 2/2006 | Sanders | 60/743 |
| 2007/0028617 | A1 * | 2/2007 | Hsieh et al. | 60/737 |
| 2007/0137207 | A1 * | 6/2007 | Mancini et al. | 60/737 |
| 2007/0289305 | A1 * | 12/2007 | Oda et al. | 60/748 |

FOREIGN PATENT DOCUMENTS

| | | |
|---|---|---|
| JP | 2002-139221 A | 5/2002 |
| JP | 2004-226051 A | 8/2004 |
| JP | 2005-180730 A | 7/2005 |

* cited by examiner

*Primary Examiner* — Darren W Gorman
(74) *Attorney, Agent, or Firm* — Westerman, Hattori, Daniels & Adrian, LLP

(57) ABSTRACT

A main swirler of a triple annular configuration that is partitioned by a pre-filmer and a separator is installed in an inlet port of a main air flow channel. The vicinity of the inner wall of the main air flow channel provided with a main fuel injection port is bulged radially outward from the innermost surface (innermost surface of a small swirler) of a main swirler. Further, a distance from the main fuel injection port and the pre-filmer is set such that an effective opening area between the pre-filmer and "the inner wall of the main air flow channel provided with the main fuel injection port" is equal to an effective opening area of the small swirler. The swirling directions of the swirlers of the main swirler are "clockwise"-"counter-clockwise"-"clockwise" respectively along the radial outward direction when the swirling direction of the innermost swirler is taken as "clockwise".

4 Claims, 4 Drawing Sheets

$\Sigma S \times$ (Flow Rate Factor) = Effective Opening Area of The Small Swirler

STAGING FUEL NOZZLE

BACKGROUND OF THE INVENTION

1. Field of the Invention

The present invention relates to a staging fuel nozzle of a gas turbine engine, and more particularly to a staging fuel nozzle that further increases combustion efficiency in a low or medium load mode of the engine and contributes to further reduction in NOx in a medium or high load mode of the engine.

2. Description of Related Art

A rich-lean combustion system based on diffusion combustion has been used in combustors of conventional jet engines for aircrafts. With such a combustion system, the correlation between the equivalent ratio $\phi$ and NOx generation amount has an almost symmetrical convex curved distribution with a center close to $\phi=1$. Therefore, by conducting combustion in a rich state (fuel-rich state) with $\phi>1$ in the upstream portion inside the combustor and then introducing air, it is possible to include combustion in a lean state (fuel-lean state) with $\phi<1$ and avoid the combustion in the vicinity of $\phi=1$, whereby suppressing the generation of NOx. A variety of technological improvements have been made to reduce NOx further, but the NOx reduction effect shows sighs of saturation. Further, a transition to a higher pressure ratio aimed at reduction in fuel consumption will inevitably increase abruptly the emission of NOx and smoke in a rich-lean combustion system.

In order to resolve this problem, a staging fuel nozzle that uses a diffusion combustion system in a pilot fuel injection portion and a premixing combustion system in a main fuel injection portion has been researched and developed extensively (see, for example, Japanese Patent Application Laid-open No. 2002-139221). With such a combustion system, fuel is premixed with a sufficient amount of air and the mixture is subjected to lean combustion in the main burner in order to prevent the appearance of high-temperature flame and reduce NOx generated in a large amount during high-temperature combustion. Accordingly, the pre-mixture for main combustion has to be supplied to combustion in a state in which fuel is sufficiently atomized and sufficiently homogeneously mixed with air.

In the main air flow channel of the staging fuel nozzle, a swirler provided around the pilot fuel injection portion and causing the air flow to swirl in the inlet of each air channel flow has a double annular configuration, and the swirlers are partitioned by an oil film forming body of a cylindrical structure called a film lip. A fuel injection port, which injects the fuel, is provided in the inner wall surface of the main air flow channel, the fuel moves downstream, while colliding with the film lip and forming a liquid film, and is stretched into a thin film by the air flow at the film lip tip and separated, whereby enhancing the atomization of fuel and uniform mixing of air and fuel (see, for example, Japanese Patent Application Laid-open No. 2004-226051). However, in the medium load mode of the engine in which the main injection portion starts operating, the injection speed of fuel is low. Therefore, a major portion of the fuel cannot reach the film lip and flows along the inner wall surface of the air channel. As a result, in the medium load mode of the engine, the fuel is mixed with the air and supplied to combustion, while still being insufficiently atomized. As a consequence, the combustion becomes unstable, a diffusion combustion mode is realized, and a large amount of NOx is generated. A fuel injection valve is known (see, for example, Japanese Patent Application Laid-open No. 2005-180730) in which in order to resolve this problem, the atomization lip (film lip) of the main fuel flow channel has a double annular configuration (the inlet of the main air flow channel has a triple annular configuration), a fuel injection port is provided in the outer circumferential surface of the inner atomization lip, the atomization of the fuel and homogeneous mixing of air and fuel are enhanced by the outer atomization lip in a high load mode of the engine, and the atomization of the fuel and homogeneous mixing of air and fuel are enhanced by the inner atomization lip in a medium load mode of the engine.

SUMMARY OF THE INVENTION

In the fuel injection valve in which the atomization lip has a double annular configuration, fuel apparently can be subjected to atomization by a swirling flow and atomization lip in a medium load mode of the engine.

However, since the amount of air for improving the atomization of fuel is less than the total amount of air passing through the main air flow channel, the effect thereof is small. Further, since a fuel-rich zone appears on the inside in the radial direction of the annular outlet of the main air flow channel, NOx can be easily generated.

As described hereinabove, in all of the above-described staging fuel nozzles, fuel is premixed with a sufficient amount of air and the mixture is subjected to lean combustion in the main burner to prevent the generation of high-temperature flame and reduce the amount of NOx that is generated in a large amount during high-temperature combustion, but these staging fuel nozzles have not yet reached the stage of practical use. Further increase in combustion efficiency in a low or medium load mode of the engine and further reduction in NOx in a medium or high load mode of the engine are necessary to put the staging fuel nozzles to practical use.

In view of the above-described problems inherent to the conventional technology, it is an object of the present invention to provide a staging fuel nozzle that further increases the combustion efficiency in a low or medium load mode of the engine and contributes to further reduction in NOx in a medium or high load mode of the engine.

In order to attain the above-described object, the staging fuel nozzle according to one example of this invention is a staging fuel nozzle having, in the center thereof, a pilot fuel injection portion and a main fuel injection portion of a premixing type that has at least two swirlers and a liquid film forming body (e.g., a pre-filmer) around the pilot fuel injection portion, wherein a fuel injection port of the main fuel injection portion is provided in an inner wall surface of an air flow channel located downstream of the swirlers, a wall surface in the vicinity of the fuel injection port is made convex radially outward from an innermost surface of the innermost swirler, and the convex surface is formed at least as far as a downstream end (e.g., lip) of the pre-filmer.

a fuel injection port of the main fuel injection portion is provided in an inner wall surface of an air flow channel located downstream of the swirlers, a wall surface in the vicinity of the fuel injection port is made convex radially outward from an innermost surface of the innermost swirler, and the convex surface is formed at least as far as a downstream end (lip) of the pre-filmer.

With the above-described staging fuel nozzle, the wall surface in the vicinity of the fuel injection port bulges radially outward from the innermost surface of the innermost swirler. Therefore, the fuel injection port and the pre-filmer become closer to each other, and most of the fuel can reach the pre-filmer even in a medium load mode of the engine in which the injection speed of fuel is the lowest. Further, because the air flow channel in the vicinity of the fuel injection port is throttled, the flow speed of the swirling flow passing therethrough increases. As a result, the fuel is advantageously atomized by the swirling flow and the pre-filmer. Therefore, most of the fuel is atomized by the swirling flow and the pre-filmer in the medium load mode of the engine and supplied to combustion in a state in which the fuel is sufficiently homogenously mixed with air, combustion efficiency in the medium load mode of the engine increases, and the amount of NOx is reduced. Further, since even larger amount of the fuel reaches the pre-filmer in the high load mode of the engine, the NOx reduction effect is further increased.

In the staging fuel nozzle according to one example this invention, an effective opening area between the convex surface and the pre-filmer may be substantially equal to an effective opening area of the innermost swirler on the upstream thereof.

The above-described staging fuel nozzle has a structure in which the effective opening area of the space bounded by the convex surface and the pre-filmer is made substantially equal to an effective opening area of the innermost swirler on the upstream thereof, whereby the loss of speed when the swirling flow passes in the vicinity of the convex surface is minimized and the convex surface creates no resistance to the swirling flow. As a result, the fuel is supplied to combustion in a state in which it is sufficiently atomized and homogeneously mixed with air by the swirling flow and the pre-filmer in the entire operation range of the engine.

In the staging fuel nozzle according to one example this invention, the swirler may be a triple annular swirler and has the liquid film forming body extending downstream between the innermost swirler and the intermediate swirler, swirling directions of the innermost swirler and the intermediate swirler are opposite to each other, swirling directions of the innermost swirler and the outermost swirler are the same, and the swirlers are combined to obtain swirling of an intensity that enables the formation of a stable recirculation flow in the entire configuration.

With the above-described staging fuel nozzle, by configuring the swirlers in the above-described manner, it is possible to act upon the fuel with stronger shear forces of different swirling directions and further enhance the atomization of fuel and homogeneous mixing of air and fuel in combination with the effect of the convex surface in the vicinity of the fuel injection port. Further, since the swirling flow forms a stable recirculation flow of the pre-mixture in the combustion range, combustion can be stabilized and combustion efficiency can be increased in the entire operation range from a low load to a medium and high load of the engine in combination with the effect of the below-described backward-facing step flame stabilizer.

In the staging fuel nozzle according to one example this invention, a backward-facing step flame stabilizer may be provided between the main air flow channel and the pilot air flow channel.

By providing the backward-facing step flame stabilizer in the staging fuel nozzle, it is possible to bring reliably the pilot flame or the already burned high-temperature gas generated by the pilot flame into contact with the main pre-mixture and form stable main flame. As a result, stable lean combustion is possible.

In the staging fuel nozzle according to one example this invention, a structure may be provided that introduces the air from upstream of the pilot fuel injection portion and swirlers of the main fuel injection portion to cool a pilot flare portion and the backward-facing step flame stabilizer from the back thereof and jets out the air in the form of a film from the inner wall surface in the vicinity of the main air flow channel outlet.

Part of the pre-mixture comes into contact or collides with the inner wall surface of the main air flow channel and part of the fuel adheres to the inner wall surface of the main air flow channel. The fuel adhered to the wall surface is moved towards the outlet portion of the main air flow channel and supplied to combustion by the shear action of the pre-mixture. However, because the fuel is supplied to combustion, without being sufficiently atomized, it makes practically no contribution to increasing the combustion efficiency and reducing the amount of NOx in the combustion gas.

Therefore, in the above-described staging fuel nozzle, a jet-out port through which the air is jetted out in the form of a film is provided in the vicinity of the main air flow channel outlet in order to cause the fuel that has adhered to the inner wall surface to participate in increasing the combustion efficiency and reducing the amount of NOx in the combustion gas. As a result, the fuel that has adhered to the inner wall surface of the main air flow channel is formed into a film by the film-shaped air flow, atomized, while being pulled into the air flow, mixed with the pre-mixture flowing in from upstream, and supplied to combustion.

The following effects can be expected with the staging fuel nozzle in accordance with the present invention.

(1) Further Improvement of Combustion Efficiency in a Low Load Mode of Engine

In the conventional fuel nozzle having coaxial pilot fuel injection portion and main fuel injection portion, when the swirling of air flowing in from the main fuel injection nozzle is weak, no stable recirculation flow can be formed inside the combustor. Therefore, the combustion efficiency of pilot fuel decreases. By contrast, in accordance with the present invention, the flowing air is subjected to mutually different swirling actions created by the triple annular swirler, a stable recirculation flow can be formed inside the combustion and therefore combustion efficiency of pilot flame can be increased.

(2) Further Increase in Combustion Efficiency in Medium Load Mode of the Engine and Reduction in NOx Amount In the conventional fuel nozzle, fuel is also injected from the main fuel injection portion in the medium load mode of the engine, but because the fuel injection speed is lower than that in the high load mode and the injected fuel flow cannot sufficiently reach the pre-filmer for atomization, the atomization of fuel and mixing with air are insufficient, the combustion efficiency tends to decrease, and the amount of NOx tends to increase. By contrast, in accordance with the present invention, since the wall surface where the fuel injection port is provided bulges radially outward from the innermost surface of the upstream swirler, the fuel easily reaches the pre-filmer even when the injection speed of fuel is low, atomization of fuel can be enhanced, fuel efficiency can be increased and NOx emission can be reduced.

(3) Further Reduction in NOx in a High Load Mode of the Engine

In order to reduce the amount of NOx generated from the main flame, it is important to atomize the fuel and mix the fuel homogeneously with air. In a fuel nozzle of a pre-filming type, fuel jet collides with a cylinder (liquid film forming body) and forms a fuel film on the inner surface of the cylinder, and the fuel atomization is conducted by the inner and outer air flows at the downstream end of the cylinder. In such a fuel nozzle, in order to attain a high degree of atomization, it is necessary that the fuel jet is caused to reach the cylinder reliably even when the amount of fuel is small and the air flow has a high speed at the downstream end of the cylinder. In accordance with the present invention, the inner wall surface of the main air flow channel where the fuel injection port is provided bulges radially outward from the innermost sluice of the swirler located on the upstream side. Therefore, the fuel jet can reliably reach the cylinder and the air flow speed can be increased. Further, because the triple annular swirler in accordance with the present invention is used, fuel atomization is enhanced by shear action of adjacent swirling flows, air and fuel are mixed more homogeneously, and the amount of NOx in the combustion gas can be further reduced. In addition, the backward-facing step flame stabilizer located between the pilot air flow channel and main air flow channel demonstrates an effect of forming a stable main flame by reliably bringing the pilot flame or high-temperature burned gas produced in the pilot region into contact with the main per-mixture. Furthermore, since the film-shaped air jetting port is provided in the inner wall surface of the outlet of the main air flow channel, the fuel that has adhered to the inner wall surface of the main air flow channel is atomized by the air flow jetted out from the air jetting port, mixing of air and fuel is enhanced, combustion efficiency is increased, and contribution is made to reduction in NOx emission.

DESCRIPTION OF THE PREFERRED EMBODIMENTS

The present invention will be described below in greater detail with reference to embodiments thereof illustrated by the appended drawings. The invention is not limited to these embodiments.

Figure 1:
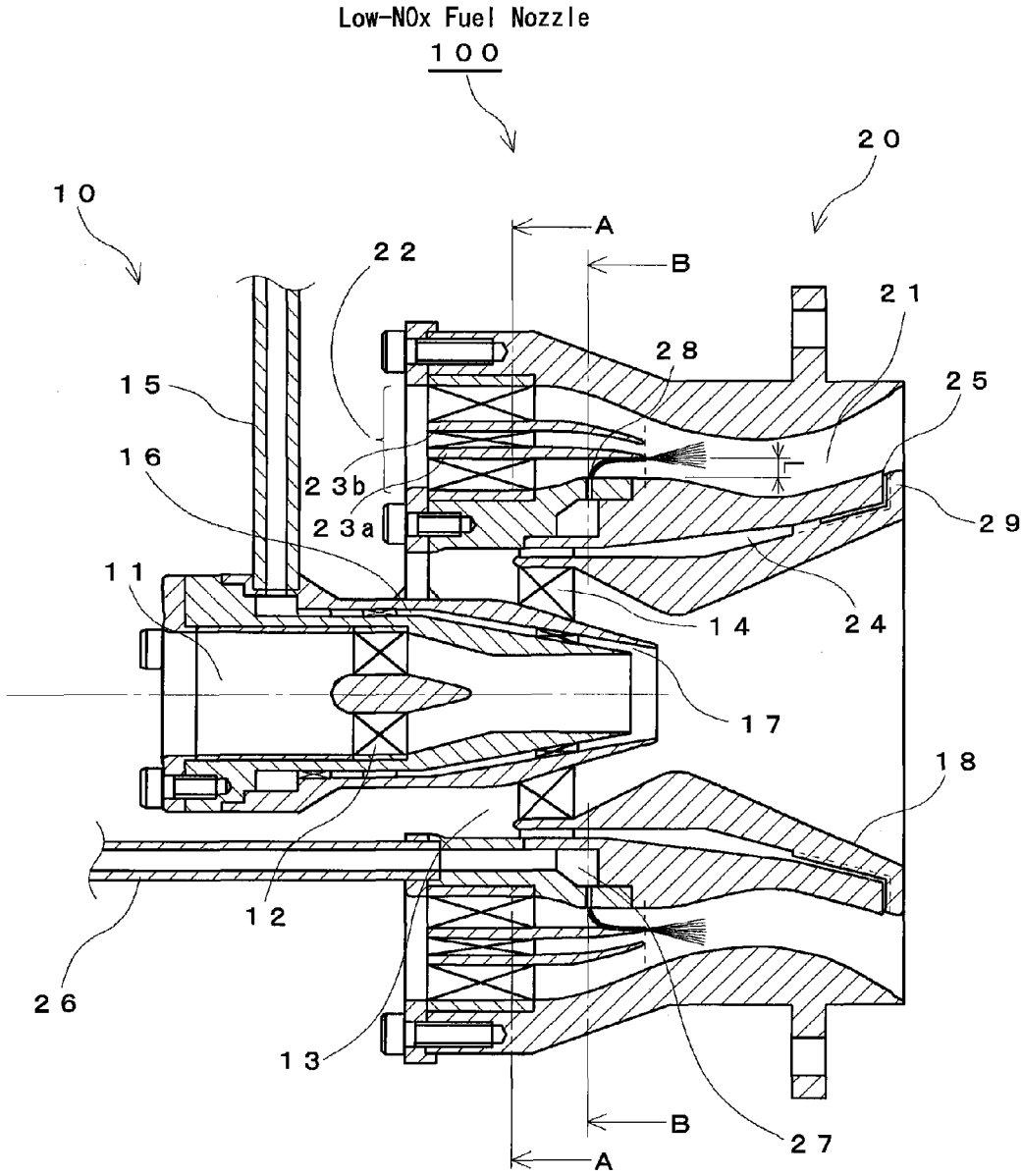
FIG. 1 is an explanatory drawing of a principal cross section illustrating a low-NOx fuel nozzle in accordance with the present invention.

FIG. 1 is an explanatory drawing of a principal cross section illustrating a low-NOx fuel nozzle 100 in accordance with the present invention.

The low-NOx fuel nozzle 100 is configured by a pilot fuel injection portion 10 that atomizes fuel for diffusion combustion such as ignition and flame stabilization (referred to hereinbelow as "pilot") and supplies the atomized fuel into a combustion chamber (not shown in the figure) and a main fuel injection portion 20 that is installed around the pilot fuel injection portion 10 and supplies a lean pre-mixture for lean premixed fuel (referred to hereinbelow as "main") of main combustion into the combustion chamber. In order to increase the combustion efficiency in a low and medium load modes of the engine and reduce NOx emission in the high-load mode of the engine, the low-NOx fuel nozzle 100 is configured so that the fuel is supplied to combustion after atomization and homogeneous mixing with air by the turbulence generated by shear of mutually different swirling flows in all the engine operation regions in which the main fuel is supplied, and a stable recirculation flow is formed inside the combustion chamber by a main swirler 22, this configuration being described below in greater detail with reference to FIGS. 2 and 3. The structural elements of this configuration are explained below.

The pilot fuel injection portion 10 is composed of a pilot first air flow channel 11 that introduces air for diffusion combustion, a pilot first swirler 12 that swirls the air flow, a pilot second air flow channel 13 that similarly introduces air for diffusion combustion, a pilot second swirler 14 that similarly swirls the air flow, a pilot fuel supply pipe 15 that introduces fuel for diffusion combustion, a pilot fuel flow channel 16 in which the pilot fuel flows, a pilot fuel injection port 17 that injects the pilot fuel, and a pilot flare portion 18 in which the fuel and air are mixed to form an air/fuel mixture and diffused.

The main fuel injection portion 20 is composed of a main air flow channel 21 that introduces air for lean premixing and combustion, a main swirler 22 that swirls the air flow, a pre-filmer 23*a* that converts the fuel into a liquid film, a film air flow channel 24 that introduces air for atomizing the fuel that has adhered to the inner wall surface of the main air flow channel 21, a film air slit 25 for jetting out the air in the form of a film, a main fuel supply pipe 26 that introduces fuel for lean premixing and combustion, a main fuel flow channel 27 in which the main fuel flows, a main fuel injection port 28 that injects the main fuel, and a backward-facing step flame stabilizer 29 that stabilizes the pilot flame. The main air flow channel is composed of an inner wall 21*a* and an outer wall 21*b*.

The main swirler 22 is a triple annular swirler partitioned by the pre-filmer 23*a* and a separator 23*b* and serves to enhance the atomization of fuel and homogeneous mixing of air and fuel and to form a recirculation flow of a stabilized pre-mixture inside the combustor.

The film air flow channel 24 is formed between the inner wall of the main air flow channel 21 and the pilot flare portion 18. The film air flow channel introduces air with a high total pressure upstream of the main swirler 22 and ejects the air in the form of a film from the film air slit 25 provided in the vicinity of the outlet port of the main air channel 21, while cooling the pilot flare portion 18 and backward-facing step flame stabilizer 29 from the rear side. The injection direction of air from the film air slit 25 crosses the pre-mixture direction (swirling flow). As a result, the fuel that has adhered to the inner wall surface of the main air flow channel 21 can be atomized, mixed with air, and supplied to combustion.

The inner wall surface of the main air channel 21 where the main fuel injection port 28 is provided is caused to bulge radially outward from the innermost surface of the main swirler 22. This bulging protrudes smoothly and continues as far as a lip tip of the pre-filmer 23*a*, so as to create no resistance to the swirling flow created by the swirler. Therefore, the fuel can reach the pre-filmer even in the medium load mode of the engine with a low fuel injection rate. At the same time, the flow velocity of air flowing through the gap (gap between the pre-filmer and the wall surface) increases. As a result, the fuel is advantageously atomized by the pre-filmer and swirling flow and supplied to combustion in a state of homogeneous mixing with air even in a medium load mode of the engine.

The effect produced by the backward-facing step flame stabilizer 29 is that stable main frame is formed by reliably bringing the pilot flame or high-temperature burned gas generated by the pilot flame into contact with the main pre-mixture. As a result, the pre-mixture supplied into the combustor by the main fuel injection portion 20 can be burned with good stability.

Figure 2:
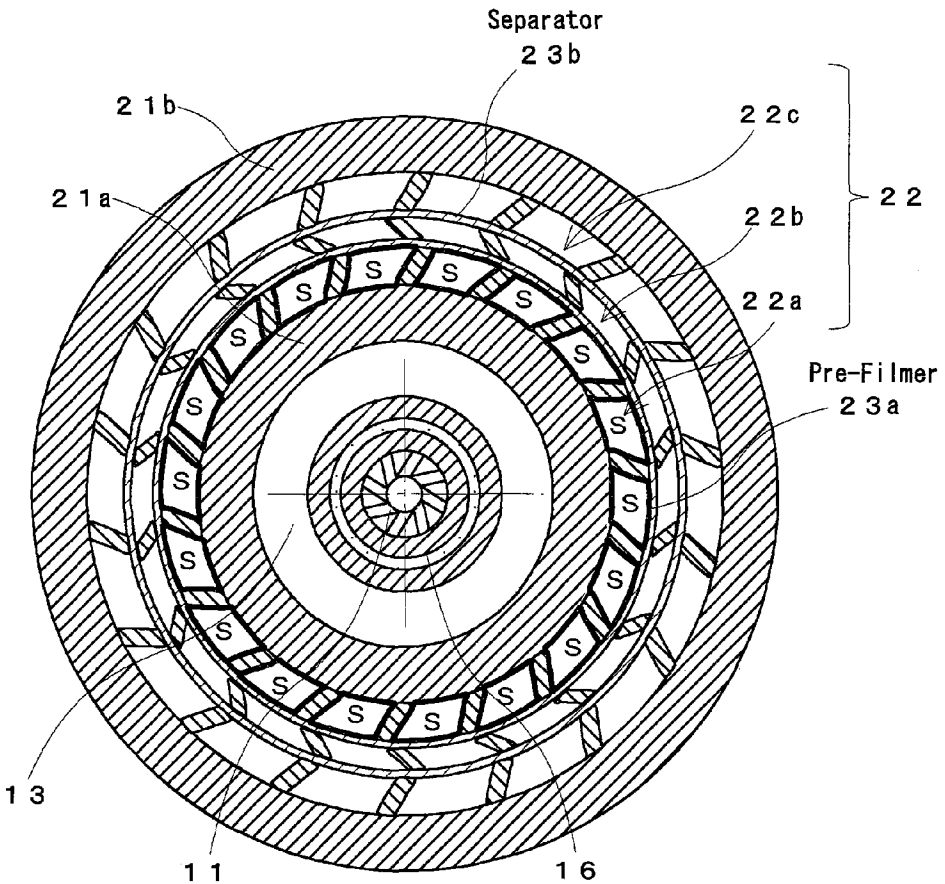
FIG. 2 is a principal cross-sectional view taken along the A-A line in FIG. 1.

FIG. 2 is a principal cross-sectional view taken along the A-A line in FIG. 1.

The main swirler 22 is a triple annular swirler in which a small swirler 22*a*, a medium swirler 22*b*, and a large swirler 22*c* are disposed concentrically in the order of description from the inside. The small swirler 22*a* and the medium swirler

22*b* are partitioned by the pre-filmer 23*a*, and the medium swirler 22*b* and the large swirler 22*c* are partitioned by the separator 23*b*.

As for the swirling direction of each swirler, the swirling direction of the small swirler 22*a* is in reverse to that of the medium swirler 22*b*, and the swirling direction of the medium swirler 22*b* is in reverse to that of the large swirler 22*c*. The swirling direction of the large swirler 22*c* is identical to that of the small swirler 22*a*. The number of vanes in each swirler, the mounting angle of the vanes, and the phase difference between the swirlers are specifically determined according to engine specifications.

In particular, an effective opening area (=ΣS×(flow rate factor)) is used in determining the below-described degree of bulging (distance L from the wall surface to the pre-filmer 23*a*) of the inner wall surface of the main air flow channel 21 where the main fuel injection port 28 is provided.

Figure 3A:
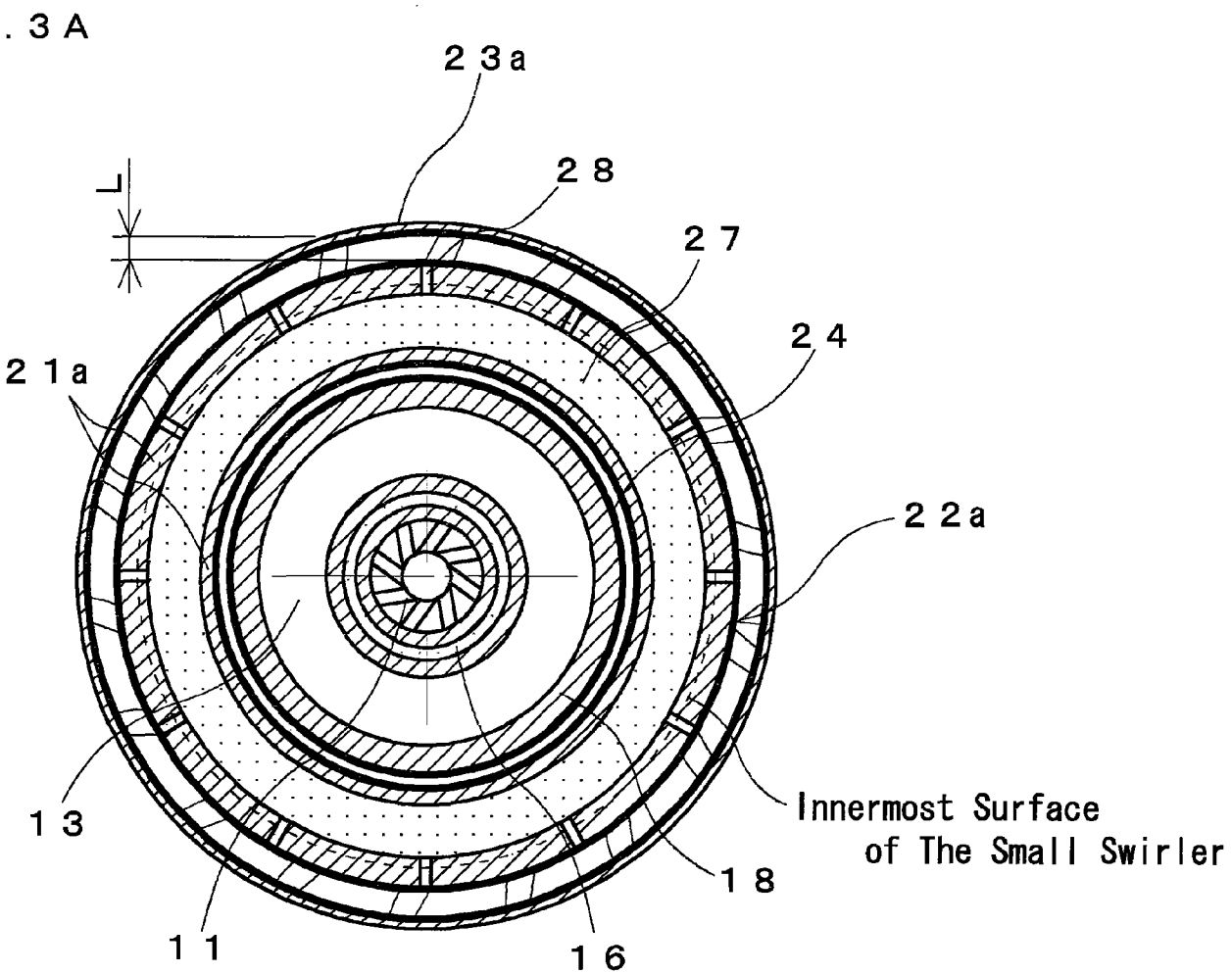
FIG. 3A or 3B is a principal cross-sectional view taken along the B-B line in FIG. 1.
Figure 3B:
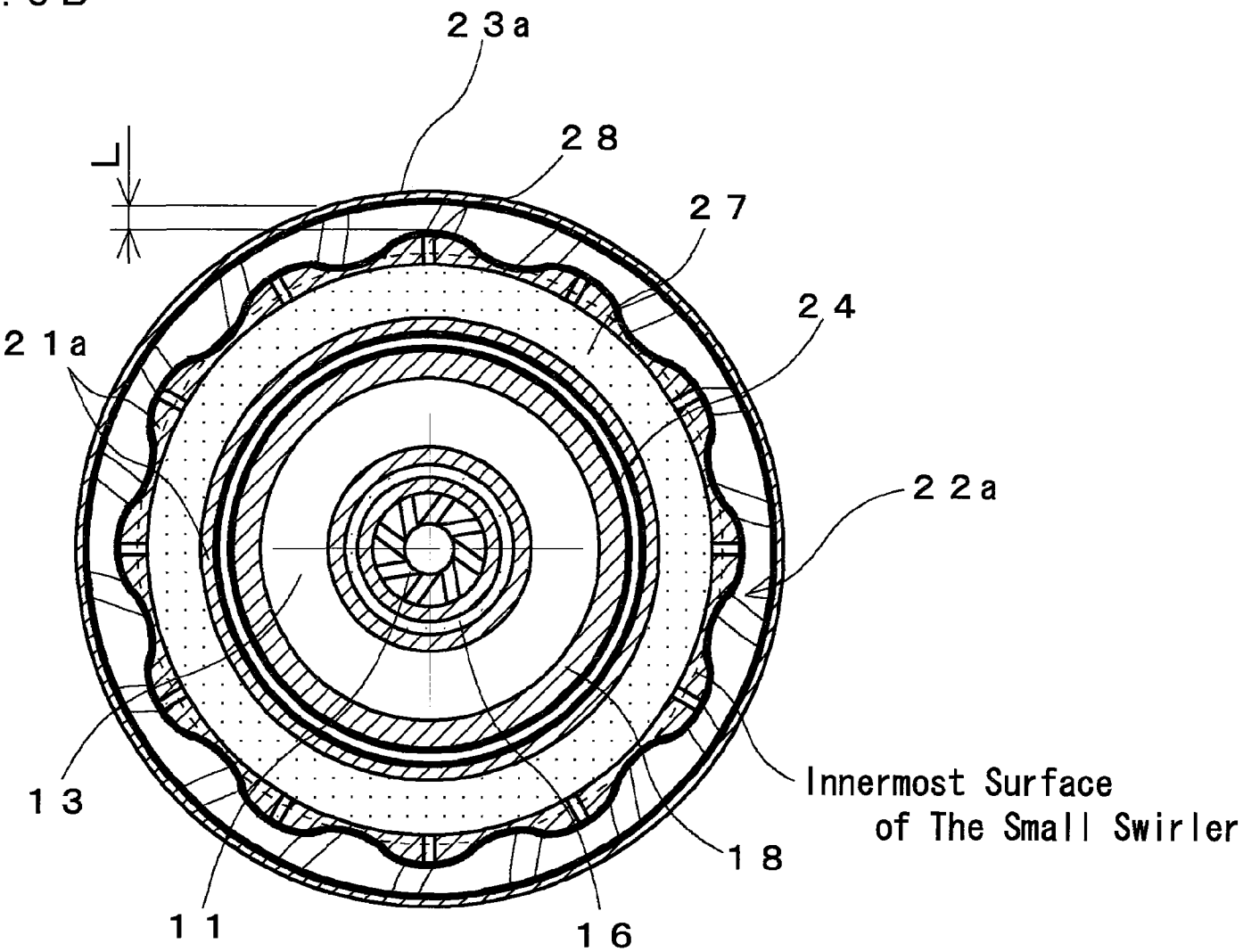

FIG. 3A or 3B is a principal cross-sectional view along the B-B line in FIG. 1. FIG. 3A shows an example in which the entire annular wall surface including the main fuel injection port 28 bulges radially outward, and FIG. 3B shows an example in which parts of the annular wall surface including the main fuel injection port 28 bulge radially outward. Further, for convenience of explanation, the medium swirler 22*b* and large swirler 22*c* are omitted.

The distance L between the pre-filmer 23*a* and the main fuel injection port 28 represents the degree of radial outward bulging of the inner wall of the main air flow channel 21, and the effective opening area surrounded by the pre-filmer 23*a* and the main air flow channel 21 is determined to be equal to the effective opening area (=ΣS×(flow rate factor)) of the small swirler 22*a*. The effective opening area as referred to herein is an area obtained by multiplying an apparent area (area calculated from the shape) by the flow rate factor.

Since the inner wall 21*a* of the main air flow channel including the main fuel injection port 28 has a structure that bulges radially, the fuel can reach the pre-filmer 23*a* even in a medium load mode of the engine with a low fuel injection rate. The velocity of the swirling flow right after passing the small swirler 22*a* is comparatively low, but because the flow channel area smoothly decreases in the vicinity of the main fuel injection port 28, the swirling flow is affected by a throttling action and the flow velocity increases. Therefore, the fuel is atomized by the swirling flow and supplied to combustion in a state of homogeneous mixing with air even in a medium load mode of the engine.

As described hereinabove, because the low-NOx fuel nozzle 100 in accordance with the present invention differs from the conventional staging fuel nozzle by the following features, fuel efficiency in a low and medium load mode of the engine can be further increased and NOx in the combustion gas in the medium and high load mode of the engine can be further reduced.

(1) The wall surface of the main air flow channel 21 including the main fuel injection port 28 bulges radially outward beyond the innermost surface of the upstream small swirler 22*a*, and the effective opening area thereof is almost equal to the effective opening area of the upstream small swirler 22*a*.

(2) The main swirler 22 is constituted by a triple annular swirler with mutually different swirling directions such that a stable recirculation flow can be formed inside the combustor.

(3) The film air slit 25 that jets out the air in the form of a film is provided in the vicinity of the inner wall outlet of the main air flow channel 21 such that the injection direction of the slit crosses the swirling flow.

(4) The backward-facing step flame stabilizer 29 is provided between the pilot fuel injection portion 10 and the main fuel injection portion 20 so as to form stable pilot flame and stable main flame.

The low-NOx fuel nozzle in accordance with the present invention can be advantageously applied to a fuel nozzle for a gas turbine that requires low NOx emission and to all of the fuel nozzles for internal combustion engines in which liquid fuel is burned continuously.

What is claimed is:

1. A staging fuel nozzle having, in the center thereof, a pilot fuel injection portion and a main fuel injection portion of a pre-mixing type that has a main swirler and a liquid film forming body around the pilot fuel injection portion, wherein the main swirler comprises a plurality of swirlers, the plurality of swirlers comprises an innermost swirler that is arranged closest to a central axis of the fuel nozzle, an intermediate swirler, and an outermost swirler, a fuel injection port of the main fuel injection portion is provided in an inner wall surface of a main fuel injection portion air flow channel located downstream of the plurality of swirlers, a wall surface in the vicinity of the fuel injection port includes a convex wall surface that protrudes radially outward from an innermost surface of the innermost swirler, the convex surface is formed at least as far as a downstream end of the liquid film forming body, and the liquid film forming body extends downstream between the innermost swirler and the intermediate swirler, the innermost swirler and the intermediate swirler swirl in an opposite direction to each other, the innermost swirler and the outermost swirler swirl in the same direction, the plurality of swirlers are combined to obtain swirling of an intensity that enables the formation of a stable recirculation flow in the entire configuration, and the main swirler is a triple annular swirler.

2. The staging fuel nozzle according to claim 1, wherein an effective opening area between the convex surface and the liquid film forming body is substantially equal to an effective opening area of the innermost swirler.

3. The staging fuel nozzle according to claim 1, wherein a backward-facing step flame stabilizer is provided between the main air flow channel and a pilot air flow channel.

4. The staging fuel nozzle according to claim 3, comprising:

a structure that introduces air from an upstream side of the pilot fuel injection portion and the plurality of swirlers of the main fuel injection portion to cool a pilot flare portion and the backward-facing step flame stabilizer from a back side thereof and jets out the air in the form of a film from the inner wall surface in the vicinity of an outlet of the main air flow channel.

* * * * *